US005507583A

United States Patent [19]

Beaty et al.

[11] Patent Number: 5,507,583

[45] Date of Patent: Apr. 16, 1996

[54] LABEL PRINTER HAVING A POSITION SENSOR

[75] Inventors: David P. Beaty, Troy; John J. Dresher, West Carrollton, both of Ohio

[73] Assignee: Premark FEG Corporation, Wilmington, Del.

[21] Appl. No.: 362,214

[22] Filed: Dec. 22, 1994

[51] Int. Cl.[6] ..... B41J 11/26

[52] U.S. Cl. ..... 400/611; 101/228; 250/559.11

[58] Field of Search ..... 400/611, 613, 400/708, 709.1, 208, 208.1, 196, 716; 250/559.01, 559.11; 101/228; 226/27

[56] References Cited

U.S. PATENT DOCUMENTS

| | | | |
|---|---|---|---|
| 3,739,968 | 6/1973 | Bodendoerfer | 226/27 |
| 4,025,025 | 5/1977 | Bartel et al. | 226/33 |
| 4,531,851 | 7/1985 | Kondo et al. | 400/708 |
| 4,700,791 | 10/1987 | Iwasaki et al. | 400/708 |
| 4,857,745 | 8/1989 | Gough | 250/548 |
| 4,909,426 | 3/1990 | Crowley et al. | 226/108 |
| 5,008,710 | 4/1991 | Kobayashi et al. | 355/202 |
| 5,018,443 | 5/1991 | Bolger | 101/228 |
| 5,061,946 | 10/1991 | Helmbold et al. | 400/708 |
| 5,180,607 | 1/1993 | Umise et al. | 427/8 |
| 5,336,003 | 8/1994 | Nagashima et al. | 400/708 |
| 5,415,484 | 5/1995 | Gallagher et al. | 400/708 |

*Primary Examiner*—Eugene H. Eickholt
*Attorney, Agent, or Firm*—Thompson Hine And Flory

[57] ABSTRACT

The invention is a printer for labels which can determine when the label stock is in position for printing. The printer comprises a print head and label stock having labels on a first side and indicator stripes printed on a second side. The printer uses an emitter for producing infrared light and a detector for receiving the light. A mirror is used to focus and reflect the light, the mirror is positioned with respect to the emitter, detector and label stock so as to reflect light originating at the emitter to the label stock and from the label stock to the detector. The invention is also drawn to the cassette used in the label printer comprising a base, a retainer on the base containing a roll of label stock, a guide plate having a window therein for conveying the label stock, a concave mirror mounted on the cassette adjacent the window, and a sensor hole on the base of the cassette through which light from an emitter and detector passes. The concave mirror is positioned with respect to the window and the sensor hole such that light emitted from an emitter is reflected from the mirror to the label stock and from the label stock to a detector wherein the guide plate, the window, the mirror and the sensor hole are aligned with each other such that the indicator stripe on the label stock can be detected.

21 Claims, 2 Drawing Sheets

LABEL PRINTER HAVING A POSITION SENSOR

BACKGROUND OF THE INVENTION

The present invention relates to an apparatus for detecting the position of label stock for printing. More particularly, this invention relates to a printer for labels having a reflective sensor for detecting the position of an indicator stripe on the label stock for the purpose of aligning the label with the print head, in which an emitter and a detector are mounted on the back side of the label stock and are mounted remotely from a removable cassette having a concave mirror, in such a way that no electrical connections to the cassette are required for sensing the label position.

It is known to print label stock to produce individual labels to mark food products for example, with their description, weight, nutritional information, etc. Traditional optical means of detecting the position of the labels include a "through beam" system wherein an emitter is placed on one side of the label stock and a detector is placed on the reverse side of the label stock. There are two methods for using through beam technology- gap or stripe indication. In the first system, the gap between the labels is sensed as a change in transmitted light intensity. The disadvantage of this approach is that the sensors may detect false gaps depending on liner quality, paper variations, and the presence of pre-printed information on the label.

In the stripe method, a black stripe is printed on either the front or the back of the label supply. When the indicator stripe is present, the light from the emitter does not pass through the labels and is not detected by the detector. The presence of a black bar provides a more definitive transition and is more reliable than the gap method. However, this method is still subject to errors due to the presence of certain pre-printed information. This therefore, restricts the position of the pre-printed information as well as the design and appearance of the labels. The appearance is also affected by the black bar on the face of the label seen by the consumer.

One example of a printer which employs a "through beam" detector is shown in U.S. Pat. No. 5,336,003 to Tokyo Electric Co. This printer employs a prism on one side of the label stock to conduct the light emitted from an emitter to another prism located on the other side of the label stock. A gap between the labels is sensed as disclosed above. This system suffers from the problems previously mentioned from positioning the emitter and detector on opposite sides of the label stock. Also, this system uses a cassette. It is not practical to put electrical connections on a cassette to accomplish the detection, since the electrical connections cannot be simply, reliably and repeatedly made to the cassette. This need to produce the electronics on each cassette greatly hampers the manufacturability and reliability in use and greatly increases the cost of each cassette.

Therefore, it is an object of the present invention to provide a printing apparatus in which the emitter and the detector are on the same side of the label stock and in which a concave mirror mounted on a removable cassette is present to focus and reflect the light being detected to signal that a label is in position for printing. It is a further object of the present invention to provide a printing apparatus in which the labels are supplied from a removable cassette which is free of electrical components.

SUMMARY

In accordance with the present invention, a printer for labels comprises a printing station having a print head; label stock having labels on a first side and indicator stripes printed on a second side; a sensor having an emitter for producing light and a detector for receiving said light; a concave mirror for focussing and reflecting said light, said mirror being positioned with respect to said emitter, detector and label stock so as to reflect light originating at said emitter to said label stock and from said label stock to said detector; and a guide plate perpendicular to the base of a cassette having a window therein; wherein said sensor and said mirror are positioned facing said second side of said label stock such that light emitted from said emitter is reflected from said mirror to said label stock and from said label stock via said mirror to said detector. Preferably, said emitter and detector lie on the same plane. The emitted light is substantially parallel to said label stock and said mirror is at an acute angle to said sensor so that it reflects the light substantially perpendicular to said label stock.

As used herein, "light" defines any detectable radiation and is not limited to visible light. For example, ultraviolet and infrared radiation are also suitable for use in the present invention. The preferred light used in the present invention is infrared radiation.

Also, in accordance with the present invention, a cassette for use in a label printer is provided comprising a base; a retainer on said base containing a roll of label stock having labels on a first side and indicator stripe imprinted on a second side; a guide plate perpendicular to said base having first label facing-side which is parallel to said label stock and a second mirror-facing side, said guide plate having a window therein; a concave mirror mounted on said cassette adjacent to said window; and a hole in said base of said cassette for light to be emitted and detected; said concave mirror being positioned with respect to said window and said hole such that light emitted from an emitter is reflected from said mirror to said label stock and from said label stock to a detector; and wherein the guide plate window, mirror and hole are aligned to each other such that said indicator stripe on the label stock can be detected.

BRIEF DESCRIPTION OF THE DRAWINGS

The invention will now be described by way of example and with reference to the accompanying drawings, in which.

DETAILED DESCRIPTION OF THE PREFERRED EMBODIMENTS

Figure 1:
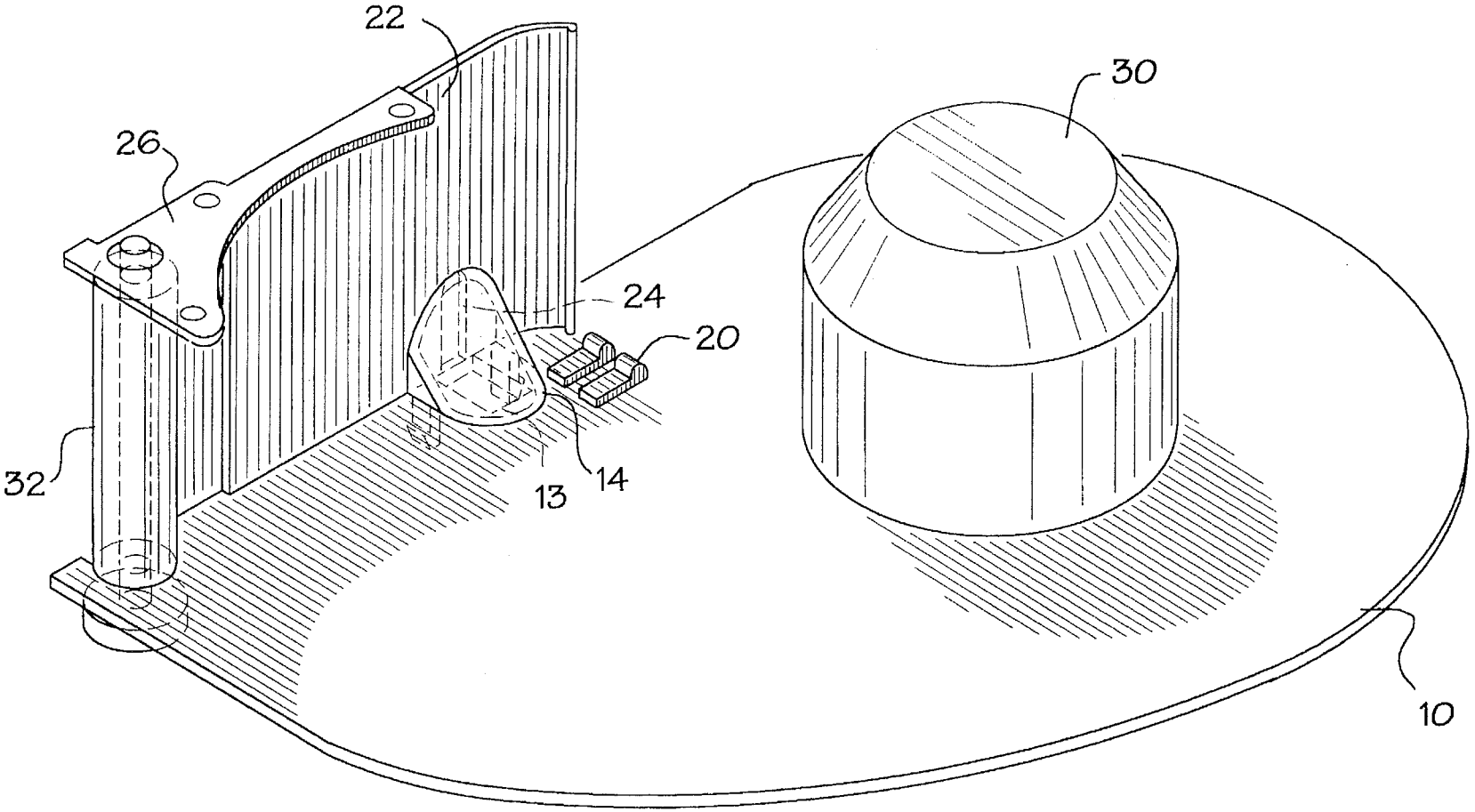
FIG. 1 is a label cassette of the present invention.

In a typical embodiment of the present invention, a sensor pack having an emitter and a detector is mounted on the floor off a label printer. Label stock 40 is provided which includes labels 44 on the front side of the label stock and an indicator stripe 42 which is preferably a black bar on the back side of each label to signal when each new label is in a position for printing. The label stock lies on its side within a cassette so that the black bar faces the interior of the cassette. A guide plate 22 having a window 24 is used in conjunction with a spring plate 26 to hold the labels in place during the detection. A concave mirror 14 is mounted and placed at a nominally 45 degree angle to the label stock. Light from the emitter is reflected off of the mirror 14 onto the label stock 40. Then the light reflected from the label stock is reflected off of the mirror 14 down to the detector 18. When the indicator stripe 42 is present, no reflection from the label via the mirror is detected and the printer is signaled that a new label 44 is aligned with the print head.

This system will now be described in detail below with respect to the figures. It is to be understood that the forgoing general description and the following detailed description are exemplary and explanatory but are not to be restrictive of the invention. The accompanying drawings which are incorporated in and constitute a part of this invention, illustrate the embodiments of the invention, and, together with the description, serve to explain the principles of the invention in general terms. Like numerals refer to like parts throughout the disclosure.

Figure 2:
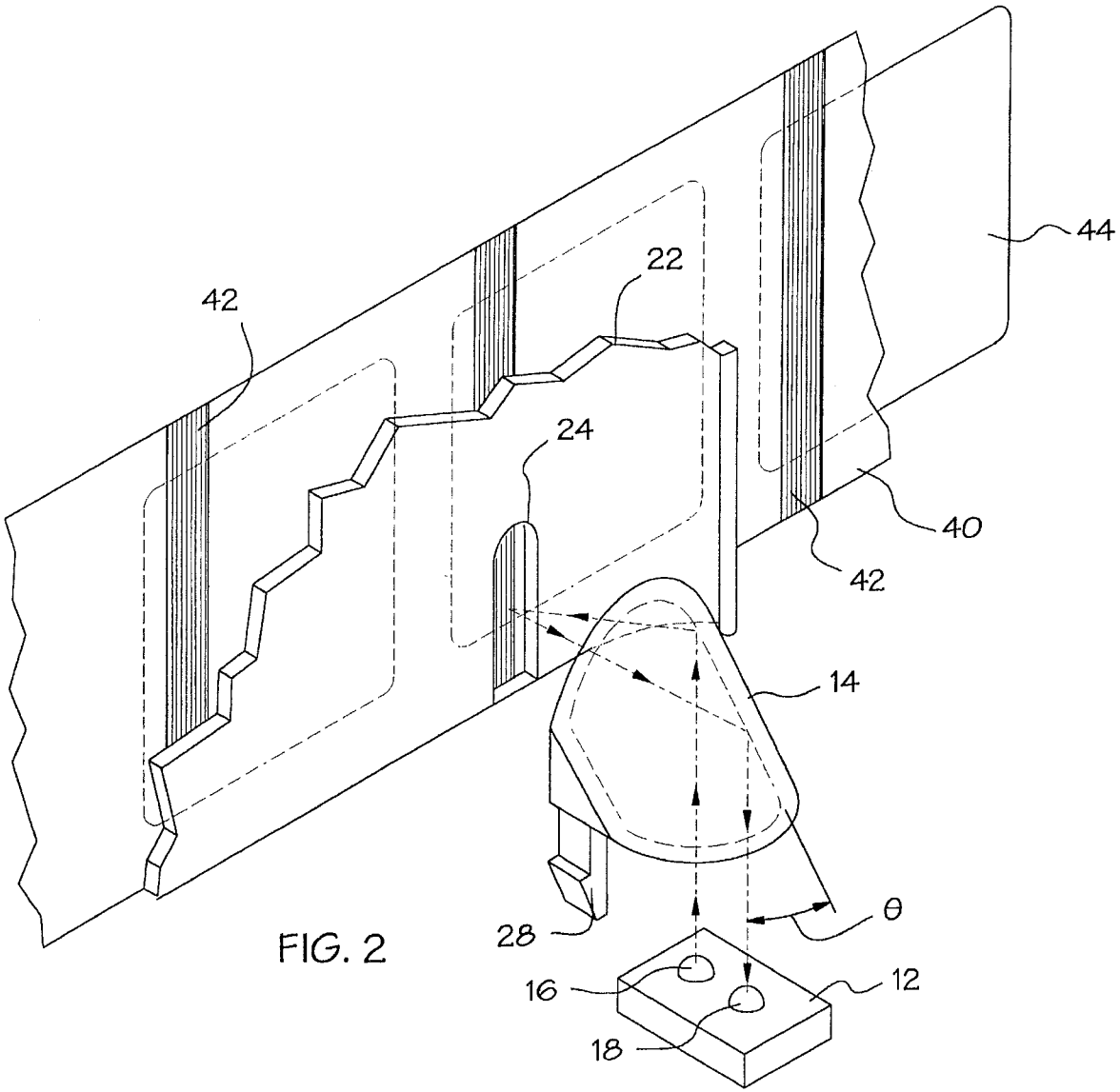
FIG. 2 is a diagram of the path of light reflection.

FIG. 1 shows a removable label cassette 10 for use in the present invention which feeds the label stock (not shown in FIG. 1) to a print roller 32 which interfaces with a print station of a printer. The print station prints a desired image on each label when it comes in contact with a print head, preferably a thermal print head. A sensor pack 12 is shown in outline facing vertically on the floor of the printer and is positioned under the cassette. The light to be emitted and detected emerges through a sensor hole 13 in the base of the cassette. This sensor pack 12 is mounted on the printer and lies beneath a mirror 14. It includes a side by side emitter 16 and detector 18 as shown in FIG. 2. Since the emitter and detector are located very close together, the reflected beam is focussed along the same path to the detector. The emitter and detector used in this invention are commercially available. One emitter suitable for use in the present invention is QEC, 123, an infrared light emitting diode manufactured by Quality Technologies Corp. of Sunnyvale, Calif. A suitable detector is OP5704, an NPN silicon phototransistor manufactured by Optek Technology, Inc. of Carrollton, Tex. At least one cam 20 which activates a switch in the printer is also preferably placed next to the sensor pack which will signal that the cassette of labels is in place. The back of the label stock is preferably imprinted with a black bar indicator. This black bar is sensed and used to align the label with the print head and notify the printer that a label is in position for printing.

The indicator stripe must be at a fixed position with respect to the label. It may be positioned at the leading edge of each label or at any point such that by detecting the indicator stripe, the exact position of the label within the printer can be determined. As an example, a typical black bar indicator stripe may be 0.300 inches from the leading edge of the label.

The label cassette 10 uses a guide plate 22 to convey labels to the print head. It provides tension and maintains a fixed distance from the label stock to the mirror. This guide plate has a window 24 which has a width smaller than or equal to the width of the black bars 42 on the label stock. This window exposes the back of the label stock and through this window, the black bar is detected. The window 24 should be aligned with the focal point of the mirror. In addition, the guide plate 22 is preferably painted black or is coated with a non-reflective surface in at least the window portion in order to increase the contrast and reduce the reflection within the printing system. Otherwise, the detector 18 will become saturated with light reflected from the guide plate. The reflected beam is inherently diverging and if the guide plate is reflective, there may be enough light to trigger the detector erroneously. In addition, the cassette employs a spring plate 26 (e.g. a plate which is biased into engagement with the guide plate by a torsion spring) to hold the label stock against the guide plate. This is important from the standpoint of getting an accurate and consistent reading of the position of the label.

In addition, the spring plate has a slot (not shown) that lines up with the window on the guide plate. This slot is a little larger than the guide plate window. This is important for an out of label condition. When the printer runs out of labels, there is nothing to reflect the light, so the sensor "sees" a black bar. When the software advances the label stock and the sensor still "sees" a black bar, then it is assumed that the printer is out of labels.

The mirror 14 is mounted on the base of the cassette. Typically, the mirror includes plastic tab feet 28 shown in FIG. 2, which snap into place in sockets provided on the base of the cassette. The mirror is preferably placed at an acute angle θ, preferably approximately a 45° angle to the emitter beam. In accordance with a preferred embodiment, this mirror is concave and, more particularly, is cylindrically concave. A pure concave mirror is more difficult to work with because it must be aligned with the light path in two dimensions, whereas the cylindrical concave mirror only requires alignment in one dimension. Stainless steel may be employed to make the mirror however, electroplated plastic, such as a chrome plated molded plastic, is more efficient.

The cassette 10 is preferably substantially light tight when placed in the printer so that ambient light does not penetrate the cassette and interfere with the detection of the indicator stripe. The periphery of the cylindrical concave mirror provides a good contact to the guide plate and the sensor hole fits the contours of the mirror to prevent reflections. Light entering the chamber from the sides would not be a dangerous source of detection errors since the periphery of the mirror is in contact with both the base of the cassette and against the guide plate so as to provide a substantially light tight channel between the sensor pack and the window in the guide plate. This is a further advantage of using the cylindrical concave mirror. Because of its orientation, the mirror also does not accumulate dust on its interior reflective surface. This is a hazard since dust may diffuse the reflected light, reducing the sensitivity and giving inaccurate or no readings.

The cassette further includes a pay out roller 30, an take up roller for the liner, and a print roller 32 which is positioned directly opposite the thermal print head (not shown). The print head is not a part of the cassette but is mounted in the printer.

Therefore, in accordance with the present invention, as shown in FIG. 2, the light from the emitter is sent from the emitter 16 substantially parallel to the label stock to the mirror 14 where it reflects substantially perpendicular to the label stock 40. The reflected light from the label stock is sent back to the mirror 14 and reflected back, substantially parallel to the label stock, down to the detector 18.

The radius of curvature of the mirror is selected to focus the light. The objective is to focus as much of the emitter beam onto the label stock as possible, and more importantly to collect and focus a sufficient amount of light reflected from the label stock to trigger the detector. The radius of curvature must be large enough to capture the light beam and maximize its intensity. In one example, the mirror employed preferably has about a 0.4 inch radius.

The light path in the printer is typically about 1 to 2 inches. This is significantly longer than the light path used in the prior art printers. As a result of this longer light path, there is a need for a more efficient system to focus the light on the bar and to capture the reflected light. Therefore, the cylindrical concave mirror is preferred over a flat or simple concave mirrors. The inventors have discovered that this type of cylindrical, concave mirror focuses the light to the most intense brightness on the label stock. Also, the concave mirror minimizes divergence and scattering. However, a flat or concave mirror may be used without departing from the scope of the invention.

By using the printing apparatus of the present invention, alignment of the label stock is not difficult. The label stock moves through the cassette on its side and is retained against the guide plate by the spring plate. The combination of the base of the cassette and the guide plate will assure proper alignment.

The printer system of the present invention employs a narrow angle emitter to maximize the amount of light reaching the label stock, and a wide beam angle detector to collect as much diffuse light as possible. Specifically, the emitter preferably diverges less than about 10° from the center, whereas the detector preferably detects light deviating up to about 40° from the center line. A narrow beam, high output emitter was selected to get as much light as possible to the target. By using a wide angle detector, a tolerance is automatically built into the printer design for misalignments between the sensor and the cassette as it is inserted into the machine, and for manufacturing variation in the printer.

The light employed to detect the black bar on the labels is preferably infrared radiation. However, other visible light or ultraviolet can be used without departing from the scope of this invention. In addition, to increase the sensitivity, a modulated emitter light may be used.

The printer preferably incorporates software wherein the system is continuously adjusted so as to be able to identify accurately the position of the label. Basically, the detector will detect the change in intensity of light from the reflective label background to the non-reflective black background and this change will occur over time as the black bar passes through the detector beam. For example, the black bar is not detected when it first appears in the window. Only when a substantial portion of the window is covered by the black bar is enough light blocked so that the detector will sense the black bar indicator and determine the label is in the printing position. It is critical to be able to determine the position of the label within about 0.25 inch (0.5 mm) so that the printed image is positioned precisely on the label. The correction involves defining a threshold change in intensity from the maximum intensity white to the minimum intensity black which is indicative of a label being in position to be printed. The labels produced by some label manufacturers may not be as white as others and would have less intensive changes from black to white. Accordingly, the system includes compensating software to give it the reliable intelligence to accurately determine the position of the label.

Having described the invention in detail and by reference to preferred embodiments thereof, it will be apparent that modifications and variations are possible without departing from the scope of the invention defined in the appended claims.

What is claimed is:

1. A printer for labels comprising:

a printing station having a print head;

label stock having labels on a first side and indicator stripes printed on a second side;

a sensor having an emitter for producing light and a detector for receiving said light adjacent to the emitter;

a mirror for focussing and reflecting said light, said mirror being positioned with respect to said emitter, detector and label stock so as to reflect light originating at said emitter to said label stock and to reflect and focus light from said label stock to said detector; and for conveying said label stock past a point at which light emitted by said emitter impinges said second side of said label stock, to said printing station;

wherein said sensor and said mirror are positioned facing the same side of said label stock such that when said detector detects said indicator by a reflection, said label stock is in a predetermined position to print an image on said label stock.

2. The printer of claim 1 wherein the mirror is concave.

3. The printer of claim 1 wherein said mirror is at an approximately 45° angle to said sensor and to said label stock.

4. The printer of claim 1 wherein said emitter and said detector lie on the same plane and emit and detect light which is substantially parallel to said label stock.

5. The printer of claim 1 wherein said light is infrared light.

6. A printer for labels comprising:

a printing station having a print head;

label stock having labels on a first side and indicator stripes printed on a second side;

a sensor having an emitter for producing light and a detector for receiving said light adjacent to the emitter;

a mirror for focussing and reflecting said light, said mirror being positioned with respect to said emitter, detector, and label stock so as to reflect light originating at said emitter to said label stock and to reflect and focus light from said label stock to said detector;

a removable label cassette to provide said label stock; and means for conveying said label stock past a point at which light emitted by said emitter impinges said second side of said label stock, to said printing station;

wherein said sensor and said mirror are positioned facing the same side of said label stock such that when said detector detects said indicator by a reflection, said label stock is in a predetermined position to print an image on said label stock and said sensor is mounted in said printer independent of said cassette.

7. The printer of claim 6 wherein said mirror is mounted on said cassette.

8. The printer of claim 6 wherein said means for conveying said label stock is a guide plate perpendicular to a base of said cassette having a window therein.

9. The printer of claim 8 wherein said cassette has a spring plate to hold said label stock against said guide plate.

10. The printer of claim 8 wherein said guide plate window has a width less than a width of said indicator stripe and wherein said mirror focuses said light into said window.

11. The printer of claim 8 wherein a periphery of said mirror contacts both said guide plate and said sensor hole to provide a substantially light tight channel.

12. The printer of claim 6 wherein said mirror is positioned at an angle of about 45° with respect to said label stock.

13. The printer of claim 12 wherein said mirror has a radius of curvature large enough to capture said light emitted by said emitter and reflected by said label stock.

14. A printer for labels comprising:

a printing station having a print head;

label stock having labels on a first side and indicator stripes printed on a second side;

a sensor having an emitter for producing light and a detector for receiving said light adjacent to the emitter;

a cylindrical concave mirror for focussing and reflecting said light, .said mirror being positioned with respect to said emitter, detector, and label stock so as to reflect light originating at said emitter to said label stock and to reflect light from said label stock to said detector; and a conveyor for conveying said label stock past a point at which light emitted by said emitter impinges said second side of said label stock, to said printing station;

wherein said sensor and said mirror are positioned facing the same side of said label stock such that when said detector detects said indicator by a reflection, said label stock is in a predetermined position to print an image on said label stock.

15. A cassette for use in a label printer comprising:

a base;

a retainer on said base containing a roll of label stock having labels on a first side and indicator stripes printed on a second side;

a guide plate perpendicular to said base for conveying said label stock and having a first label-facing side and a second mirror-facing side, said guide plate having a window therein;

a concave mirror mounted on said cassette adjacent said window; and a sensor hole on said base of said cassette through which light from an emitter and detector passes;

said concave mirror being positioned with respect to said window and said sensor hole such that light emitted from an emitter is reflected from said mirror to said label stock and from said label stock to a detector; and wherein said guide plate, said window, said mirror and said sensor hole are aligned with each other such that said indicator stripe on said label stock can be detected.

16. The cassette of claim 15 wherein said window has a width less than a width of said indicator stripe and wherein said mirror focuses said light into said window.

17. The cassette of claim 16 wherein said cassette has a spring plate to hold said label stock against said guide plate.

18. The cassette of claim 15 wherein said mirror is a cylindrical concave mirror.

19. The cassette of claim 15 further comprising a guide plate for directing label stock past said sensor, said guide plate having a window wherein a periphery of said mirror contacts both said guide plate and said sensor hole to provide a substantially light tight channel.

20. The cassette of claim 15 wherein said mirror is positioned at an angle of about 45° with respect to said label.

21. The cassette of claim 20 wherein said mirror has a radius of curvature large enough to capture said light emitted by said emitter.

* * * * *